United States Patent [19]

Sze et al.

[11] 4,108,798

[45] Aug. 22, 1978

[54] PROCESS FOR THE PRODUCTION OF PETROLEUM COKE

[75] Inventors: Morgan C. Sze, Upper Montclair; Thomas M. Bennett, Scotch Plains; Andre A. Simone, Parsippany, all of N.J.; Kiyoshige Hayashi, Tokyo, Japan; Mikio Nakaniwa, Ome, Japan; Nobuyuki Kobayashi; Yoshihiko Hase, both of Ichihara, Japan

[73] Assignees: The Lummus Company, Bloomfield, N.J.; Maruzen Petrochemical Co., Ltd., Tokyo, Japan

[21] Appl. No.: 702,647

[22] Filed: Jul. 6, 1976

[51] Int. Cl.[2] ..... C10G 9/14; C10G 37/02; C10B 55/00

[52] U.S. Cl. ..... 252/502; 208/125; 208/50; 208/131; 423/450

[58] Field of Search ..... 208/50, 131, 125; 252/502; 423/450

[56] References Cited

U.S. PATENT DOCUMENTS

| | | | |
|---|---|---|---|
| 3,472,761 | 10/1969 | Cameron | 208/131 |
| 3,537,976 | 11/1970 | Alexander et al. | 208/76 |
| 3,547,804 | 12/1970 | Noguchi et al. | 208/46 |
| 3,687,840 | 8/1972 | Sze et al. | 208/131 |
| 3,759,822 | 9/1973 | Folkins | 208/131 |
| 3,794,579 | 2/1974 | Enomoto et al. | 208/40 |
| 3,959,115 | 5/1976 | Hayashi et al. | 208/131 |
| 4,049,538 | 9/1977 | Hayashi et al. | 208/131 |

*Primary Examiner*—Herbert Levine
*Attorney, Agent, or Firm*—Michael Klotz; Elliot M. Olstein

[57] ABSTRACT

A high crystalline coke can be prepared by heat-soaking a petroleum feedstock in the presence of added dissolved sulfur, heating to effect controlled thermal cracking thereof, separating non-crystalline substances as pitch, recovering a heavy cokable residue from the pitch free feed, and subjecting the residue to delayed coking.

12 Claims, 1 Drawing Figure

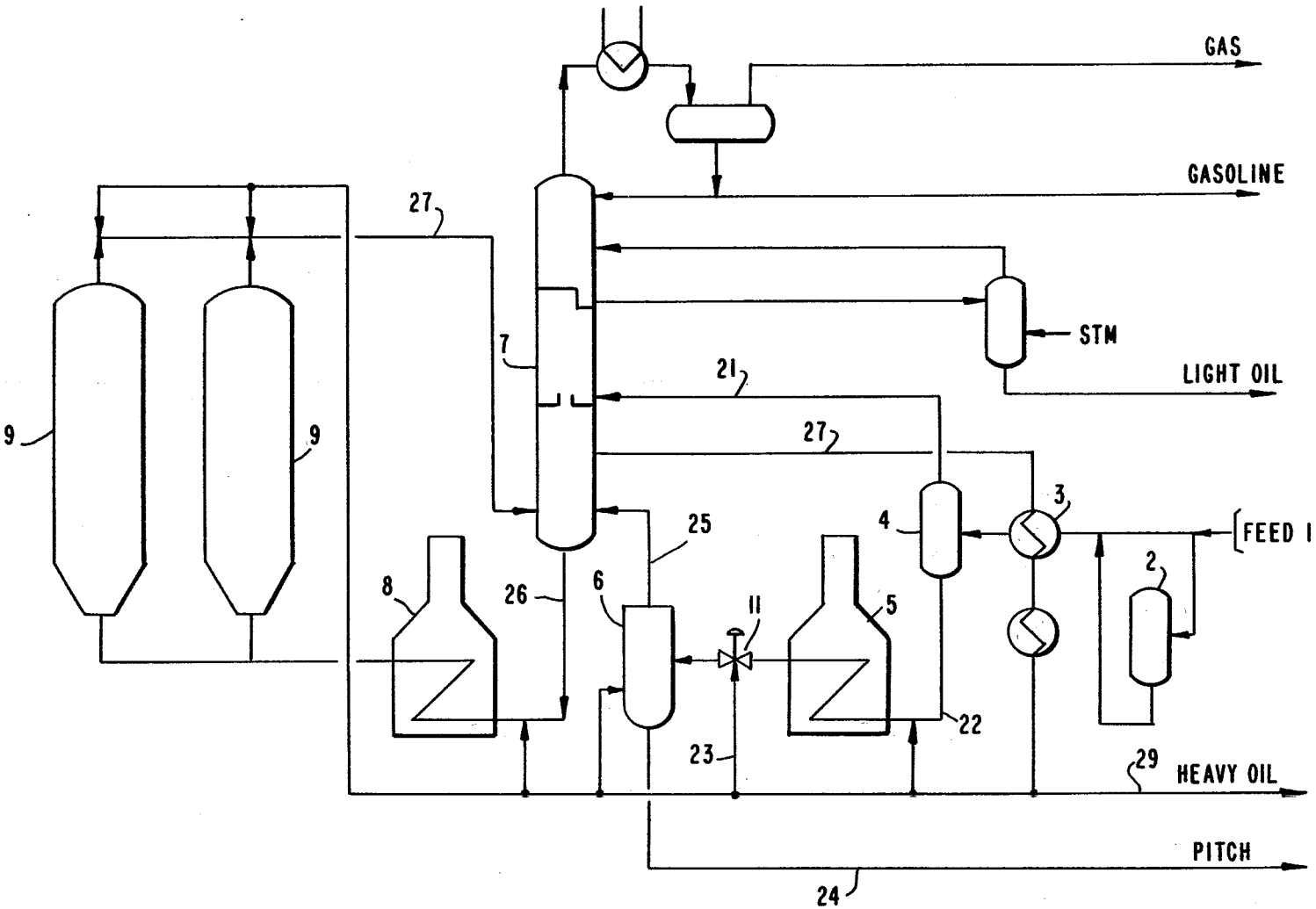
GAS
GASOLINE
STM
LIGHT OIL
FEED I
HEAVY OIL
PITCH
2
3
4
5
6
7
8
9
9
11
21
22
23
24
25
26
27
27
29

PROCESS FOR THE PRODUCTION OF PETROLEUM COKE

The invention relates to a process for producing ultra-high crystalline petroleum coke, that is, a coke which is superior in quality to the so-called "premium grade" coke, and which is suitable for the manufacture of graphite electrodes for UHP (ultra high power) operations; e.g., electric furnaces for making steel.

In U.S. application Ser. No. 613,541, now U.S. Pat. No. 4,049,538 there is disclosed a process for the production of a high crystalline petroleum coke suitable for UHP operations, which process comprises the steps of providing a petroleum feedstock selected from the group consisting of a virgin crude oil having a sulfur content of 0.4% by weight or less; a distillation residue derived from the crude oil; a cracked residue having a sulfur content of 0.8% by weight or less; and a hydrodesulfurized product having a sulfur content of 0.8% by weight or less of any residue from a distillation or cracking of petroleum, heating the feedstock in a tube heater to a temperature of 430° to 520° C under a pressure of 4 to 20 kg/cm$^2$G in the presence of absence of a hydroxide and/or carbonate of an alkali or alkaline earth metal, maintaining the feedstock in the tube heater at that temperature for 30 to 500 seconds to effect cracking thereof, introducing the heat-treated feedstock into a high-temperature flashing column, where flash-distillation is effected at a temperature of 380° to 510° C under a pressure of 0 to 2 kg/cm$^2$G, continuously removing noncrystalline substances contained in the feedstock as pitch from the bottom of the flashing column, fractionating the overhead effluent from the flashing column into cracked gas, gasoline, kerosene, gas oil and heavy residue, heating the heavy residue from the fractionation to a temperature required for the subsequent delayed coking, and introducing the heated heavy residue into a coking drum, where it is subjected to delayed coking at a temperature of 430° to 460° C under a pressure of 4 to 20 kg/cm$^2$G for at least 20 hours, thereby forming a high-crystalline petroleum coke having a coefficient of thermal expansion of less than $1.0 \times 10^{-6}$/° C over 100° to 400° C when measured in the form of a graphite artifact thereof. According to this process (hereinafter referred to as "Pitch process"), it is possible to obtain a high quality coke suitable for the production of graphite electrodes for UHP operations, but in the pretreatment of the feedstock for removing non-crystalline carbon-forming substances (hereinafter referred to as non-crystalline substances) which are easily cokable, the feedstock must be subjected to cracking and soaking in a tube heater under rather severe conditions for a relatively long period of time. Thus, depending on the nature of feedstock, coking of non-crystalline substances contained in the feedstock may occur in the tube heater or in the flasher, with the result that the tube may become plugged and/or the complete and efficient removal of pitch becomes difficult. This is particularly disadvantageous in continuous coking operations as interruptions for the purpose of cleaning would make the operations unduly costly. This tendency is particularly prominent in the use of a cracked residue from pyrolysis at a high temperature. Based on the discovery that a hydroxide or carbonate of an alkali or alkaline earth metal possesses a retarding action for pitch-forming and coking reactions of various heavy oils and residue, a small amount of such a salt can be added to the feedstock with the result that the noncrystalline substances contained in the feedstock can be efficiently removed as pitch to improve coke quality and plugging of equipment is prevented. However, such an alkali or alkaline earth metal salt is accumulated in the pitch removed from the bottom of the flashing column, resulting in corrosion problems and an adverse effect on pitch quality.

As is already known from the U.S. Pat. No. 3,687,840, plugging of transfer lines and other parts of a coking unit, can be effectively prevented by pretreating a heavy residue feed by dissolving 30 to 200 parts per million of sulfur in the form of elemental sulfur or mercaptan in the heavy residue, followed by preheating and soaking at a temperature high enough and for a time long enough to effect the polymerization of highly unsaturated compounds. According to the said U.S. patent, when a thermally cracked residue with low sulfur content and high aromatics content is pretreated by the process disclosed therein, it is possible to obtain a premium grade coke having a coefficient of thermal expansion over 30° to 100° C in the direction parallel to the extrusion of $1.1 \times 10^{-6}$/° C, when measured in the form of a graphite artifact thereof. This value is considered to correspond to a coefficient of thermal expansion (CTE) over 100° to 400° C in the direction parallel to the extrusion of $1.2 \times 10^{-6}$/° C or higher, probably $1.5 \times 10^{-6}$/° C or higher, the latter temperature range, 100° to 400° C, being usually adopted for evaluating coke which is to be employed for the production of graphite electrodes. In general, cokes having such CTE values are not suitable for UHP operations.

As a result, there is a need for an improved process for producing high crystalline petroleum coke from petroleum feedstocks of the type described to provide a premium grade coke suitable for UHP operations.

It is an object of the invention to provide a process for producing high crystalline petroleum coke suitable for UHP operations.

It is a further object of the invention to produce coke superior in properties to the coke produced by the above-described "Pitch process".

In accordance with the present invention, there is produced high crystalline petroleum coke by separating non-crystalline substances as pitch from the pretreated feedstock, followed by separating a heavy cokable residue from the pitch-free fraction and subjecting same to delayed coking. It has been found that the coke produced in accordance with the present invention has properties superior to the coke produced by the hereinabove described "Pitch process", and in addition, plugging of the reaction system is avoided without the necessity of employing salt additives.

More particularly, the invention provides a process for producing high crystalline petroleum coke from a petroleum feedstock, comprising: heat soaking a petroleum feedstock at a temperature of at least 230° C for at least 5 minutes in the presence of 30 to 200 parts per million of added dissolved sulfur in the form of at least one member selected from the group consisting of elemental sulfur, mercaptan and carbon disulfide, said petroleum feedstock being a residual heavy oil having no greater than 1.5 wt.% sulfur which is selected from the group consisting of distillation residues, cracked residues and hydrodesulfurized distillation and cracked residues; heating the heatsoaked feedstock to effect controlled thermal cracking thereof at a pressure of no greater than 50 kg/cm$^2$G and to a final temperature of from 450° to 530° C; separating non-crystalline substances as pitch to produce a pitch free feed; recovering a heavy cokable residue from the pitch free feed; and subjecting the heavy cokable residue to delayed coking to produce high crystalline petroleum coke.

The necessary residence time in the cracking section of the radiant section may vary from 20 seconds or less to 2 minutes or more if heat transfer conditions are difficult. Thus, the residence time may be as low as 15 or 17 seconds, or as high as 120 seconds, in accordance with the heat transfer characteristics of the plant. Under commercial conditions, a residence time of between 30 seconds and 120 seconds is preferable for the achievement of the best results.

The feedstocks treated in accordance with the present invention are heavy petroleum feedstocks having low sulfur contents, i.e., a sulfur content of 1.5 wt.% or less, preferably of 0.8 wt.% or less, which are either a virgin crude oil preferably having a sulfur content of 0.4 wt.% or less, a distillation residue derived from the crude oil, a cracked residue or a hydrodesulfurized product of a residue from the distillation or cracking of petroleum. Preferred feedstocks are the so-called pyrolysis fuel oils or black oils which are the residual heavy black oils boiling above pyrolysis gasoline; i.e., boiling above 187° to 218° C, which are produced together with olefins in the pyrolysis of liquid hydrocarbon feeds.

The petroleum feedstock is initially soaked, as hereinabove described, in the presence of sulfur at a temperature of at least 230° C, generally a temperature of from 230° C to 315° C for at least 5 minutes, most generally from 5 to 120 minutes. The pressure is a pressure sufficient to prevent vaporization of the feedstock, generally atmospheric or a little higher than atmospheric pressure.

The soaked feedstock is then heat treated to effect controlled thermal cracking thereof. The heat treatment following the heat soaking is performed by heating the feedstock in a tube heater under pressure of less than 50 kg/cm$^2$G, usually 4 to 25 kg/cm$^2$G, so that the feedstock is finally heated to a temperature of 450° to 530° C, namely at the outlet of the tube heater. As hereinabove discussed, the residence time in the cracking section of the radiant section will generally be from as low as 15 seconds to as high as 120 seconds.

The heat treating conditions of the present invention differ from the heat treating conditions employed in the hereinabove described Pitch process; i.e., the heat treatment conditions of the Pitch process were 430° to 520° C, for a residence time of 30 to 500 seconds, at a pressure of 4 to 20 kg/cm$^2$G.

The heat treated feedstock is then processed to remove noncrystalline substances, as pitch therefrom. In particular, the heat-treated feedstock is immediately introduced into a high-temperature flashing column, where it is subjected to flashing at a temperature of 380° to 510° C under a pressure of 0 to 2 kg/cm$^2$G. In the flashing, the non-crystalline substances can be selectively removed as a pitch bottoms. The pitch thus obtained is as high in quality as that obtained by the "Pitch process". It has such a high degree of aromaticity that it resembles coal pitch. Furthermore, it is further characterized by a low viscosity above a certain temperature for its high pour point and high softening point, and its yield can be held at a low level. In other words, the process realized by the present invention offers such advantages that both the yield and the quality of coke obtained in the subsequent coking stage can be significantly improved.

The overhead effluent from the high-temperature flashing column is further fractionated into light fractions (including gas, gasoline and gas oil), leaving a heavy residue which is recovered from the bottom of the flashing column for production of coke, by a delayed coking process. The heavy residue is heated in a tube heater to a temperature required for coking and is then subjected to delayed coking in a coking drum. The coking conditions are also of importance. The delayed coking is performed at a temperature of 430° to 460° C under a pressure of 4 to 20 kg/cm$^2$G, and a satisfactory coking can be obtained usually in 24 to 30 hours. In terms of coking time, the process of the present invention is superior to the "Pitch process" for the commercial production of petroleum coke.

The invention will be further described with respect to the accompanying drawing, wherein:

The drawing is a simplified schematic flow diagram of an embodiment of the present invention.

Referring now to the drawing, there is shown a raw material tank 1, a pot of sulfur solution 2, a soaking heater 3, a soaking drum 4, a tube heater 5, a high-temperature flashing column 6, a main fractionator column 7, a coker heating furnace 8, and a coking drum 9.

A slipstream of the fresh feed from feed tank 1 is passed through sulfur pot 2 to dissolve sulfur therein and provide the hereinabove described amount of sulfur for the soaking of the feed. The sulfur may be directly dissolved in the feed or a solution of sulfur, for example, in xylene, may be added to the feed.

The sulfur containing feed is passed through exchanger 3 wherein the feed is indirectly heated by a heavy oil fraction and the heated feed is introduced into the soaking drum 4 wherein the feed is soaked as hereinabove described.

Vapor from the soaking drum 4 is introduced through line 21 into fractionator 7. The soaked liquid is withdrawn from tank 4 through line 22, pressurized by a pump (not shown), and passed through a tubular heater 5 wherein the soaked feed is heated at a pressure of from 4 to 50 kg/cm$^2$G, preferably 4 to 25 kg/cm$^2$G, to an outlet temperature of from 450° to 530° C to effect controlled cracking thereof.

The heat treated feed is withdrawn from heater 5 and passed through a pressure reducing valve 11, with the heat treated feed being cooled by direct quenching with a heavy oil in line 23.

The cooled feed is then introduced into flash column 6 to flash lighter components from non-crystalline substances which are removed as a pitch from the bottom of column 6 through line 24.

The flashed overhead withdrawn from column 6 through line 25 is introduced into a fractionator 7, of a type known in the art, to recover a coking feedstock, as bottoms through line 26, a heavy oil through line 27, and light oil, gasoline and gas fractions, as shown.

The coking feedstock in line 26 is passed through coking heater 8 and introduced into coke drums, schematically indicated as 9 to effect delayed coking thereof. The coke drums are used in alternate cycles of about 24 hours each.

Vapor withdrawn from coke drums 9 through line 27 is introduced into the fractionator 7 to recover the various fractions, as known in the art.

The heavy gas oil fraction recovered from fractionator 7 through line 27 is employed to preheat the feedstock by indirect heat transfer in exchanger 3, with a portion thereof being recovered as product through line 29. A further portion of the heavy oil is employed in line 23 to effect cooling of the effluent from heater 5, by direct quenching, as hereinabove described. Further portions of the heavy oil, as required, may be combined with the feed in lines 22 or 26, introduced into the flash tower 6 or combined with overhead vapors from the coke drum in line 27.

Important parameters for evaluation of the quality of coke for use in the production of graphite electrodes to be used in electric furnace operations, especially UHP operations, include coefficient of thermal expansion, electric resistivity, crushing strength, and size and structure of the coke crystals. However, there are no established methods and procedures for measurement and evaluation of such parameters, and opinion is divided concerning the interpretation of such parameters. The most widely used parameter for coke quality evaluation is the coefficient of thermal expansion (hereinafter abbreviated as CTE) in the direction parallel to the extrusion (over 100° to 400° C) of coke as measured in the form of a graphite artifact thereof.

It has been found that the maximum transverse magnetoresistance of coke as measured in the form of a graphite artifact thereof can serve as a rather satisfactory parameter for evaluation of the quality of coke for use in the manufacture of graphite electrodes.

Maximum transverse magnetoresistance $(\Delta\rho/\rho)$ TLmax is defined as follows:

$$(\Delta\ \sigma/\sigma)\ TL\max\% = \frac{(\sigma_H - \sigma_o) \times 100}{\sigma_o}$$

where, $\rho_o$ = resistivity in the absence of a magnetic field $\rho_H$ = resistivity in the presence of a magnetic field

| | | |
|---|---|---|
| Measuring conditions: | Field intensity | 10 KGauss |
| | Temperature | 77° K |

The magnetic field is applied to the sample in perpendicular direction. Details of the measurement are based on the method reported by Yoshihiro Hishiyama et al. in Japanese Journal of Applied Physics, Vol. 10, No. 4 pages of 416–420 (1971). The field intensity being fixed, the value of maximum transverse magnetoresistance is the greatest for the single crystal graphite with no crystalline defect but remarkably decreases with increasing crystalline defects. It is also known that the observed values of maximum transverse magnetoresistance are independent of the shape of the coke sample.

The relations of maximum transverse magnetoresistance to coefficient of thermal expansion (CTE), coefficient of cubic expansion (CCE) and electric resistivity, all of which were measured on samples in the form of graphite artifact, have been studied and it has been found that the lower the values of CTE, CCE and electric resistivity, the higher the value of maximum transverse magnetoresistance. Further, the observation of electron scanning photomicrographs and reflected polarized-light photomicrographs of these samples has shown that with the increase in the value of maximum transverse magnetoresistance, the crystalline texture of coke is of higher growth, of better orientation and of higher layer stacking. Thus, it is revealed that maximum transverse magnetoresistance has a very close relationship with such parameters as CTE and electric resistivity heretofore used for the evaluation of coke quality and that it well reflects the crystalline structure of coke. Maximum transverse magnetoresistance can therefore be considered to be a rational parameter for coke quality evaluation. For the method and procedure for measurement of maximum transverse magnetoresistance and relevent information reference is made to U.S. Pat. application Ser. No. 614,675 now U.S. Pat. No. 4,040,946.

From such studies, it has been found that a coke suitable for the production of electrodes for UHP operations should have a maximum transverse magnetoresistance of at least 16.0% and a CTE (over 100°–400° C) of no greater than $1.0 \times 10^{-6}/°$ C. A high crystalline petroleum coke having CTE (over 100°–400° C) in the direction parallel to the extrusion of less than $1.0 \times 10^{-6}/°$ C has been produced by the aforementioned "Pitch process" (U.S. patent application Ser. No. 613,541); by a two-stage coking process (U.S. Pat. No. 3,959,115 issued May 25, 1976) and its modification (U.S. patent application Ser. No. 613,541) and by a coking process using a special coking drum called a coking crystallizer (U.S. patent application Ser. No. 614,675) and such cokes are a satisfactory material for graphite electrodes for UHP operations. The value of CTE as low as $1.0 \times 10^{-6}/°$ C could not be achieved in the conventional premium grade cokes. The high-crystalline coke thus obtained which has CTE over 100° to 400° C of less than $1.0 \times 10^{-6}/°$ C showed a value of maximum transverse magnetoresistance of at least 16% without exception and often a still higher value of 20% or more.

On the other hand, the experiments with premium and regular grade petroleum cokes showed that the former had a value of CTE (over 100°–400° C) in the order of $1.0–1.2 \times 10^{-6}/°$ C and a value of maximum transverse magnetoresistance in the order of 6–10%, while the latter had CTE (over 100°–400° C) of $1.2 \times 10^{-6}/°$ C or more and maximum transverse magnetoresistance in the order of only 3–6%.

It has been found that high crystalline cokes can be produced in accordance with the present invention which have a CTE lower than and/or a maximum transverse magnetoresistance higher than the cokes heretofore produced in the art.

The maximum transverse magnetoresistance and CTE which were used as parameters for coke quality evaluation in the present invention were measured as follows:

MAXIMUM TRANSVERSE MAGNETORESISTANCE

Green coke was calcined at a temperature of 1,400° C for 3 hours. Forty (40) parts of 35–65 mesh fraction of the calcined coke and 60 parts of 100 mesh plus fraction of the same were blended with 30 parts of coal binder pitch and kneaded at a temperature of 170° C. The mixture was extruded to form a green extruded rod 20 mm in diameter and 200 mm in length, and the green road was baked at a temperature of 1,000° C for 3 hours and graphitized at a temperature of 2,700° C for 1 hour. Artifacts of certain specific size and shape were prepared from this graphite rod, and their maximum transverse magnetoresistance was measured at a temperature of 77° K (temperature of liquid nitrogen) and a field intensity of 10 K Gauss.

CTE (COEFFICIENT OF THERMAL EXPANSION)

An electrode was made by calcination and extrusion of coke in the same manner as in the preparation of artifacts for measurement of maximum transverse magnetoresistance, and the electrode was baked at a temperature of 1,000° C for 3 hours and graphitized at a temperature of 2,700° C for 0.5 hour. It was then cut into artifacts of certain specific size and shape, and the CTE (over 100°–400° C) in the direction parallel to the extrusion was measured on the graphite artifact.

For the purpose of illustration, this invention will now be further illustrated by the following examples, but it should be understood that the invention is not limited thereto or thereby.

EXAMPLE 1

The properties of the cracked residue (ethylene bottoms) and cracked residue (tar bottoms) obtained as by-products of naphtha cracking and gas oil cracking for the production of olefins are shown in Table 1, and the coking conditions in Table 2.

Table 1

| Starting Feedstock | Ethylene Bottoms | Tar Bottoms |
|---|---|---|
| Specific gravity, 15° /4° C | 1.074 | 1.083 |
| Sulfur content, wt.% | 0.07 | 0.76 |
| Asphaltene content, wt.% | 15.6 | 14.3 |
| 5% distillation temperature, ° C | 205.5 | 245 |
| Average molecular weight | 268 | 324 |

Table 2

| Starting Feedstock | | Ethylene Bottoms | Tar Bottoms |
|---|---|---|---|
| Soaking drum 4 | Amount of sulfur added, wt. ppm | 50 | 50 |
| | Temperature, ° C | 261 | 260 |
| | Residence time, min. | 15 | 15 |
| Tube heater 5 | Outlet temp., ° C | 476 | 478 |
| | Residence time, sec. | 17 | 17 |
| | Pressure, kg/cm²G | 25 | 25 |
| Flashing column | Temperature, ° C | 439 | 467 |
| | Pressure,kg/cm²G | 0.5 | 0.5 |
| Coking drum | Temperature, ° C | 440 | 440 |
| | Pressure,kg/cm²G | 6.5 | 9.0 |
| | Reaction time, hrs. | 24 | 24 |

Green coke is produced at the rate of 12.5 kg/hour. The coke obtained is calcined and extruded to form a green extruded rod, and the rod is baked and graphitized at a temperature of 2,700° C according to the aforementioned procedure. The properties of the coke in the form of graphite artifacts are such that the CTE is very small and the value of maximum transverse magnetoresistance is very high, as shown in Table 3, furnishing evidence to indicate that high-crystalline petroleum coke of an excellent quality is obtained.

Table 3

| Starting Feedstock | Ethylene Bottoms | Tar Bottoms |
|---|---|---|
| CTE in the direction parallel to the extrusion (over 100–400° C) $\times 10^{-6}$/° C | 0.57 | 0.60 |
| Coefficient of cubic expansion (over 120–300° C) $\times 10^{-6}$/° C | 6.6 | 6.8 |
| Maximum transverse magnetoresistance, %TLmax | 27.0 | 21.7 |

EXAMPLE 2

This example illustrates a bench scale test simulation of the process flow scheme embodying the present invention in comparison with two other processes, one being the same as the present invention without the soaking stage in the presence of sulfur and the other being the "Pitch process". The coke produced in accordance with the invention has superior properties. The starting feedstock used in these experiments was a cracked residue called ethylene bottoms obtained as a by-product from thermal cracking of naphtha for the production of ethylene and had such properties as shown in Table 1.

Elemental sulfur was dissolved in xylene preheated to a temperature of 90° C in a concentration of 1% by weight, and the sulfur solution was added to the feedstock at a rate of 50 ppm by weight calculated as elemental sulfur. The sulfur-containing feedstock was preheated to a temperature of 260° C and then charged into a 4-inch soaking drum heated to a temperature of 260° C by an electric heater at a flow rate of 36 kg/hr. The feedstock was held in the soaking drum under a pressure of 2 kg/cm²G for 15 minutes to effect heat soaking. During soaking, the light fraction was removed from the top of the soaking drum at a flow rate of 8.6 kg/hour.

The soaked feedstock was withdrawn from the bottom of the soaking drum at a flow rate of 27 kg/hour and passed through an AISI 304 stainless steel tube (6 mm inner diameter, 4 m length and 1 mm thickness) immersed in a heating medium, so as to be heated to a final temperature of 480° C under a pressure of 25 kg/cm²G. After heating, the feedstock was introduced into the hightemperature flashing column maintained at a temperature of 440° C by external heating by an electric heater. Pitch was continuously withdrawn from the bottom of the flashing column at a flow rate of 7.4 kg/hour, and the overhead effluent from the flashing column was fractionated into a light fraction boiling up to 250° C recovered at a rate of 3.5 kg/hour and the heavy oil recovered at a rate of 16.1 kg/hour, such heavy oil recovery being 45.1% by weight based on the flasher charge.

The heavy oil was charged into the coking drum maintained at a temperature of 440° C under a pressure of 6.5 kg/cm²G at a rate of 1 kg/hr, where it was subjected to delayed coking for 24 hours. The yield of coke was 22.1% by weight based on the coker charge (or 10.0% by weight based on the ethylene bottoms).

The coke was calcined and extruded to form a green extruded rod, and the rod was baked and graphitized at a temperature of 2,700° C according to the aforementioned procedure. The graphite artifacts made from the graphite rod had CTE (over 100°–400° C) in the direction parallel to the extrusion of 0.67 $\times 10^{-6}$/° C and maximum transverse magnetoresistance TLmax of 23.0% (measured at a temperature of 77° K and field intensity of 10 KGauss).

By way of comparison, the same starting feedstock as above was directly heated to a temperature of 480° C without the addition of sulfur and without the soaking stage, and the heated feedstock was charged into the high-temperature flashing column. In this case the heating tube was plugged up with coke 3 hours after the onset of the experiment. When a similar experiment was carried out at a reduced heating temperature of 430° C, the coke yield was as low as 7.4%, by weight, based on the ethylene bottoms, and the coke thus obtained had CTE (over 100°–400° C) of $1.08 \times 10^{-6}$/° C and maximum transverse magnetoresistance of 15.5%.

By way of further comparison, the same starting feedstock was directly held in a tube heater 40 m long at a temperature of 430° C for 260 seconds to effect its cracking and soaking according to the "Pitch process", i.e., without presoaking in the presence of sulfur. The coke obtained by this method had CTE (over 100°–400° C) of $0.83 \times 10^{-6}$/° C and maximum transverse magnetoresistance of 18.5%. As is clear from the three experiments of coke production mentioned hereinabove, the coke obtained by the process of the present invention was of a higher quality.

EXAMPLE 3

For further illustration of the features of the present invention, the process of the present invention was compared with a process wherein the feedstock is subjected to soaking in the presence of sulfur, without subsequent control and separation of pitch, as described in U.S. Pat. No. 3,687,840; and with a process wherein the feedstock is pretreated by soaking in the presence of sulfur, without subsequent controlled cracking, followed by coking of a heavy oil fraction separated from the pitch. The starting feedstock used in these experiments was a cracked residue called tar bottoms obtained as a by-product from thermal cracking of gas oil for the production of ethylene and has such properties as shown in Table 1, and the coking operation was performed in the same equipment as used in Example 2. When a coking experiment was carried out under the same conditions as those described in Example 2, except for a final heating temperature of 490° C for controlled cracking subsequent to the soaking, the coke yield was 21.0%, by weight, based on the tar bottoms, and the coke thus obtained had CTE (over 100°–400° C) of $0.64 \times 10^{-6}$/° C and maximum transverse magnetoresistance of 21.6%, which demonstrated its high-crystalline property.

When the length of the heater tube was increased from 4 m to 20 m, the coke yield was 20.5% by weight based on the tar bottoms, and the coke thus obtained had CTE (over 100°–400° C) of $0.99 \times 10^{-6}$/° C and maximum transverse magnetoresistance of 16.2%, which indicated a degradation in quality.

For purposes of comparison, the same starting feedstock was heat soaked in the presence of sulfur, as hereinabove described, followed by distillation, in vacuo, at a temperature of 350° C. The pitch yield in this stage of distillation was 40%, and the heavy oil equivalent to 40% of the distillate was delayed coked, as hereinabove described, to produce a coke yield of 6% weight based on the tar bottoms. The coke thus obtained had CTE (over 100°–400° C) of $1.11 \times 10^{-6}$/° C and maximum transverse magnetoresistance of 10.8%.

When the same starting feedstock was heat-soaked in the presence of sulfur as hereinabove described, and immediately thereafter subjected to delayed coking, as described, the coke yield was 58.6% by weight, based on the tar bottoms, and the coke thus obtained had CTE (over 100°–400° C) of $1.51 \times 10^{-6}$/° C and maximum transverse magnetoresistance of 10.6%, which indicated that the coke cannot be qualified as the high-crystalline petroleum coke.

Numerous modifications and variations of the present invention are possible in light of the above teachings and, therefore, within the scope of the appended claims, the invention may be practiced otherwise than as particularly described.

What is claimed is:

1. A process for producing high crystalline petroleum coke from a petroleum feedstock, comprising:

heat soaking a petroleum feedstock at a temperature of at least 230° C for at least 5 minutes in the presence of 30 to 200 parts per million of added dissolved sulphur in the form of at least one member selected from the group consisting of elemental sulphur, mercaptan and carbon disulfide, said petroleum feedstock being a residual heavy oil having no greater than 1.5 wt.% sulphur which is selected from the group consisting of virgin crude oil, distillation residues, cracked residues and hydrodesulfurized distillation and cracked residues;

heating the heat-soaked feedstock to effect controlled thermal cracking thereof at a pressure of no greater than 50 kg/cm$^2$G and to a final temperature of from 450° C to 530° C;

separating non-crystalline substances as pitch to produce a pitch free feed;

recovering a heavy cokable residue from the pitch free feed;

heating said heavy cokable residue to coking temperatures; and, subjecting the heated heavy cokable residue to delayed coking to produce high crystalline petroleum coke.

Reconsideration and allowance of this application are requested.

2. The process of claim 1 wherein the feedstock is a pyrolysis fuel oil.

3. The process of claim 1 wherein the heating of the heat-soaked residue is at a pressure of from 4 to 25 kg/cm$^2$G.

4. The process of claim 3 wherein the residence time in the thermal cracking is less than 17 seconds.

5. The process of claim 3, wherein the residence time in the thermal cracking is from 30 seconds to 120 seconds.

6. The process of claim 3 wherein the heat soaking is effected at a temperature of from 230° to 315° C for a time of from 5 to 120 minutes.

7. The process of claim 1 wherein the delayed coking is effected at a temperature of from 430° to 460° C, at a pressure of from 4 to 20 kg/cm$^2$G.

8. The process of claim 7 wherein non-crystalline substances are separated as a pitch bottoms by flash distillation at a temperature of from 380° to 510° C at a pressure of from 0 to 2 kg/cm$^2$G.

9. The process of claim 8 wherein the feedstock is a pyrolysis fuel oil and the coke produced has a maximum transverse magnetoresistance (10 KGauss, 77° K) of at least 16.0% and a coefficient of thermal expansion (over 100°–400° C) of less than $1.0 \times 10^{-6}$/° C, when measured in the form of a graphite artifact thereof.

10. A high crystalline petroleum coke produced by the process of claim 1.

11. A graphite electrode prepared from a high crystalline petroleum coke produced by the process of claim 1.

12. A calcined coke prepared from a high crystalline coke produced by the process of claim 1.

* * * * *

UNITED STATES PATENT OFFICE

CERTIFICATE OF CORRECTION

Patent No. 4,108,798 Dated August 22, 1978

Inventor(s) MORGAN C. SZE, et al

It is certified that error appears in the above-identified patent and that said Letters Patent are hereby corrected as shown below:

Column 5, Line 29, "$(\Delta\rho/\rho)$" should be -- $(\Delta\sigma/\sigma)$ -- ;

Column 5, Line 36, "$\rho_c$" should be -- $\sigma_c$ -- ;

Column 5, Line 37, "$\rho_H$" should be -- $\sigma_H$ -- ;

Column 10, Lines 34 & 35, delete "Reconsideration and allowance of this application are requested."

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*